US008851981B2

(12) United States Patent
Ramsey et al.

(10) Patent No.: US 8,851,981 B2
(45) Date of Patent: Oct. 7, 2014

(54) PERSONALIZED JACKPOT WAGERING GAME, GAMING SYSTEM, AND METHOD

(75) Inventors: Patrick Ramsey, Austin, TX (US); Bradley W. Johnson, Austin, TX (US); JP Cody, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 0 days.

(21) Appl. No.: 13/562,264

(22) Filed: Jul. 30, 2012

(65) Prior Publication Data

US 2013/0029739 A1 Jan. 31, 2013

Related U.S. Application Data

(63) Continuation-in-part of application No. 13/239,171, filed on Sep. 21, 2011, now Pat. No. 8,602,877, and a continuation-in-part of application No. 13/232,900, filed on Sep. 14, 2011, now Pat. No. 8,342,957, and a continuation-in-part of application No. 12/818,402, filed on Jun. 18, 2010.

(60) Provisional application No. 61/388,598, filed on Sep. 30, 2010, provisional application No. 61/406,019, filed on Oct. 22, 2010, provisional application No. 61/388,596, filed on Sep. 30, 2010, provisional application No. 61/406,035, filed on Oct. 22, 2010, provisional application No. 61/321,406, filed on Apr. 6, 2010.

(51) Int. Cl.
*G07F 17/32* (2006.01)

(52) U.S. Cl.
USPC ..... 463/27; 463/16; 463/20; 463/25; 463/26; 463/29

(58) Field of Classification Search
USPC ..... 463/16–20, 25–29
See application file for complete search history.

(56) References Cited

U.S. PATENT DOCUMENTS

| | | | |
|---|---|---|---|
| 6,039,648 | A | 3/2000 | Guinn et al. |
| 6,227,974 | B1 | 5/2001 | Eilat et al. |
| 6,626,758 | B1 | 9/2003 | Parham et al. |
| 6,632,138 | B1 | 10/2003 | Serizawa et al. |
| 7,090,577 | B2 | 8/2006 | Serizawa et al. |
| 7,465,231 | B2 | 12/2008 | Lewin et al. |
| 7,575,517 | B2 | 8/2009 | Parham et al. |
| 7,593,740 | B2 | 9/2009 | Crowley et al. |
| 7,690,998 | B2 | 4/2010 | Okada |
| 7,811,168 | B2 | 10/2010 | Parham et al. |
| 7,871,328 | B2 | 1/2011 | Parham et al. |

(Continued)

OTHER PUBLICATIONS

PCT, International Search Report dated Jun. 17, 2011, in PCT application No. PCT/US2011/031462 (2 pages).

(Continued)

*Primary Examiner* — Omkar Deodhar
(74) *Attorney, Agent, or Firm* — Russell D. Culbertson, Esq.; JP Cody, Esq.

(57) ABSTRACT

A gaming system and method is disclosed that includes a personalized tournament or group event hosting website wherein players may participate in or organize one or more groups and/or associated group events online or at participating casinos, invite friends and acquaintances to join one or more groups, accept or extend invitations to play in tournaments or competitions, and, set up and enter tournaments or competitions.

12 Claims, 22 Drawing Sheets

(56) References Cited

U.S. PATENT DOCUMENTS

| | | | | |
|---|---|---|---|---|
| 7,887,415 | B2 | 2/2011 | Parham et al. | |
| 7,934,994 | B2 | 5/2011 | Lemay et al. | |
| 2002/0028706 | A1 | 3/2002 | Barnard et al. | |
| 2002/0111209 | A1* | 8/2002 | Walker et al. | 463/25 |
| 2003/0013516 | A1 | 1/2003 | Walker et al. | |
| 2003/0064807 | A1* | 4/2003 | Walker et al. | 463/42 |
| 2003/0114218 | A1 | 6/2003 | McClintic | |
| 2003/0224852 | A1 | 12/2003 | Walker et al. | |
| 2004/0224773 | A1 | 11/2004 | Sham | |
| 2006/0046807 | A1 | 3/2006 | Sanchez | |
| 2006/0079319 | A1 | 4/2006 | Aoki et al. | |
| 2006/0277100 | A1 | 12/2006 | Parham | |
| 2007/0259713 | A1 | 11/2007 | Fiden et al. | |
| 2008/0032800 | A1 | 2/2008 | Liu et al. | |
| 2008/0059304 | A1 | 3/2008 | Kimsey | |
| 2008/0076519 | A1 | 3/2008 | Chim | |
| 2008/0102916 | A1 | 5/2008 | Kovacs et al. | |
| 2008/0113745 | A1 | 5/2008 | Williams et al. | |
| 2009/0048012 | A1 | 2/2009 | Patel et al. | |
| 2009/0048918 | A1 | 2/2009 | Dawson et al. | |
| 2009/0104965 | A1 | 4/2009 | House et al. | |
| 2009/0111567 | A1 | 4/2009 | Park | |
| 2009/0131145 | A1 | 5/2009 | Aoki et al. | |
| 2009/0176572 | A1 | 7/2009 | Reddy et al. | |
| 2009/0189351 | A1 | 7/2009 | Baerlocher et al. | |
| 2009/0197674 | A1 | 8/2009 | Parham et al. | |
| 2009/0298039 | A1 | 12/2009 | Glazier | |
| 2010/0004058 | A1 | 1/2010 | Acres | |
| 2010/0030578 | A1 | 2/2010 | Siddique et al. | |
| 2010/0035674 | A1 | 2/2010 | Slomiany et al. | |
| 2010/0048302 | A1 | 2/2010 | Lutnick et al. | |
| 2010/0105462 | A1* | 4/2010 | Walker et al. | 463/17 |
| 2010/0130280 | A1 | 5/2010 | Arezina et al. | |
| 2010/0248818 | A1 | 9/2010 | Aoki et al. | |
| 2010/0304862 | A1 | 12/2010 | Coleman et al. | |
| 2011/0130196 | A1 | 6/2011 | Parham et al. | |
| 2011/0159940 | A1 | 6/2011 | Acres | |
| 2011/0201414 | A1 | 8/2011 | Barclay et al. | |
| 2011/0223993 | A1 | 9/2011 | Allen et al. | |

OTHER PUBLICATIONS

PCT, Written Opinion of the International Searching Authority dated Jun. 17, 2011, for PCT application No. PCT/US2011/031462 (6 pages).

PCT, International Search Report dated Feb. 22, 2012, in PCT application No. PCT/US2011/53191 (2 pages).

PCT, Written Opinion of the International Searching Authority dated Feb. 22, 2012, in PCT application No. PCT/US2011/53191 (4 pages).

PCT, International Search Report dated Feb. 22, 2012, in PCT application No. PCT/US2011/53192 (3 pages).

PCT, Written Opinion of the International Searching Authority dated Feb. 22, 2012, in PCT application No. PCT/US2011/53192 (7 pages).

* cited by examiner

311

313

415

511

OurJackpot.com – Your Current Balance:$45.68

| Jackpot Groups | Winning Numbers | Your Numbers | Jackpot |
|---|---|---|---|
| GreenBayPackers:JP | 549-652 | 859-625 | $894 |
| WisconsinBadgers:JP | 215-458 | 482-953 | $1,353 |
| World:JP | 458-586-842 | 859-869-712 | $125,345 |

513

OurJackpot.com – My Current Balance:$45.68

| Jackpot Groups | My Score | Current Position | Jackpot |
|---|---|---|---|
| GreenBayPackers:JP | 10000 | 10th | $894 |
| WisconsinBadgers:JP | 15000 | 25th | $1,353 |
| World:JP | .... | .... | $125,345 |

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

Where social meets gaming – You set the rules – OURJACKPOT.com facilitates administration of each event, maintains scores in realtime, and disseminates event info to players and members

OURJACKPOT

701

OUR JACKPOT . COM

This is a website for adult social networking in the gaming world. It provides a location where you may set up gaming tournaments or competitions — you make the rules; invite friends, old and new, to participate; and when you go on your next gaming junket, your tournament or competition is waiting for you at your specified gaming establishment.

Login or Signup (Age Verified)
Username: _____
Password: _____

This is a website for adults, 21 and over. If you are under age 21, please close this page.

To contact us:

Multimedia Games, Inc.
208 Wild Basin Rd, South
Austin, TX 78746

Phone: 555-555-5555
Fax: 555-555-5555
E-mail: someone@mm-games.com

Home | About Us | Contact Us | Product List | Service List | Calendar | Project List | Related Links | Product List

Fig. 7A

723

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

703

MY JACKPOT PAGE

Personal Info

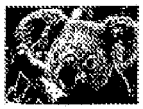

725

Access/Edit your contact info (e.g. mailing & email addresses, phone number, personal ID, avatar, etc.), your credit card info, website options (e.g. auto email notification of new tournaments / competitions)

> Access

My Current Tournament & Competition

Standings & Leader Boards

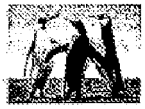

727

My Current Standings / Tournaments:

5th Place / BCCC Invitational (May 22—June 30 at Winstar) — Invited (No score) / Austin Gamers (Labor Day Weekend at Wynn, LV).

Best finish: 20000 pts—2d Place — Slugfest — Wynn on Dec. 28, 2010

Best Single Score: 1000 credits—Jambalaya Jackpot — Wynn Resort LV on Nov. 18, 2009

> Access

Eligible Tournaments (not signed up)

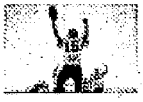

729

> More details...

For more information about this service:

E-mail: someone@example.com

OUR JACKPOT PLAYER POINTS

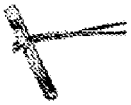

731

TODAY'S ACCRUED POINTS: 200

ACCUMULATED POINTS (12 MTHS): 3000

LIFETIME ACCUMULATED POINTS: 25000

Points are accumulated as follows:

1) 1 point for every $1 wagered at online (if legalized) or at one of our affiliates' facilities
2) 1 additional point for every $1 wagered in one of OUR JACKPOT competition or tournament
3) 1 point for every 500 credits of online free-play at Play for Fun page Home | About Us | Contact Us | Product List | Service List | Calendar | Project List | Related Links | Product List

Fig. 7B

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

705

TO CONTACT US CALL: 1-555-555-5555

MY TOURNAMENTS

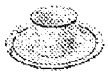

MY TOURNAMENT 1 (MYT1)

Invited / Eligible Players: Austin Gamers

When: 0001 June 25, 2011—2359 June 26, 2011

Where: Winstar, OK

EGMs: All Winstar MGAM Class II EGMs

Prizes / Entry Fees: 1st Place: 50% ; 2d Place: 25%; 3d Place 15% (of Total Entry Fees / Winners determined by point totals); Note: Minimum entries: 5 (if min not met, entry fees returned by cashable credit to OURJACKPOT or WINSTAR player club account)

Signup: At any Winstar Class II MGAM EGM, enter tournament: MYT1 ; your username, & password ; entry fee: $10

> Pay Entry Fee — Entry Fee: $10

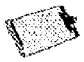

MY TOURNAMENT 2 (WYNN-0.01)

Invited / Eligible Players: All WYNN Players Club Members

When: 0600 June 25, 2011— 2000 June 26, 2011

Where: Wynn, Las Vegas

EGMs: 0.01 denomination EGMs (all manufacturers)

Prizes / Entry Fees: 1st Place: $100, 2nd Place: $50, 3d Place: $25, plus each base award is respectively progressively increased by 2, 1, and 0.5% of total wagers in tournament (All awards paid to Wynn Player accounts as 50% non-cashable credits and 50% cashable credits on or about 2030 June 26, 2011)

Signup: Wynn Player Card at any 0.01 denom EGM

> Pay Entry Fee — Sponsored Event/Entry Fee: $0

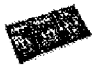

MY TOURNAMENT 3 (MGAM-0.25)

Invited / Eligible Players: All WYNN Players Club Members

When: 0600 July 1, 2011— 2000 July 4, 2011

Where: Any affiliate location with 0.01 MGAM EGMs (Class II or Class III)

EGMs: 0.01 denomination MGAM EGMs

Prizes / Entry Fees: 1st Place: $100, 2nd Place: $50, 3d Place: $25, plus each base award is respectively progressively increased by 2, 1, and 0.5% of total wagers in tournament (All awards paid to OUR JACKPOT (or to an affiliate) Player accounts as cashable credits on or about 2030 June 26, 2011)

Signup: At any 0.01 denom MGAM EGM at OUR JACKPOT affiliate locations

Sponsor: Multimedia Games

> Pay Entry Fee — Entry Fee: $00.00

Home | About Us | Contact Us | Product List | Service List | Calendar | Project List | Related Links | Product List

Fig. 7C

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

707

MY LEADERBOARD

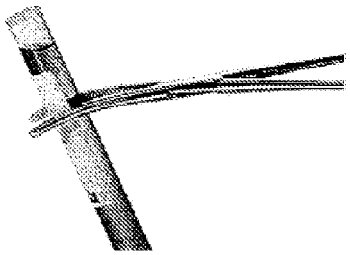

MY TOURNAMENT 1 (MYT1)

| Place | Name | Score | Status |
|---|---|---|---|
| 1 | j%c | $1600 | Playing |
| 2. | A# | $ 880 | Not Playing |
| 3. | B*c | $ 470 | Online, not playing |

Players currently playing: 100
Players entered: 300

To contact us:

Phone: 555-555-5555
Fax: 555-555-5555
E-mail: someone@mn-games.com

Home | About Us | Contact Us | Product List | Service List | Calendar | Project List | Related Links | Product List

Fig. 7D

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

709

MY CALENDAR

June 2011

| Sun | Mon | Tue | Wed | Thu | Fri | Sat |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | | | | | |

SCHEDULE OF EVENTS

> 00/00/00 — Type the date of an upcoming event. Type the name of the event, the time, location, and a phone number to call for more information. Upcoming events are auto-populated from your MY TOURNAMENT page. Your Outlook, Yahoo calendars, or other calendar applications can be linked to auto-populate on your cell phone by identifying your cell phone number through your OUR JACKPOT page.

More details...

> 00/00/00 — Type the date of an upcoming event. Type the name of the event, the time, location, and a phone number to call for more information.

More details...

> 00/00/00 — Type the date of an upcoming event. Type the name of the event, the time, location, and a phone number to call for more information.

More details...

> 00/00/00 — Type the date of an upcoming event. Type the name of the event, the time, location, and a phone number to call for more information.

More details...

To contact us:

Phone: 555-555-5555
Fax: 555-555-5555
E-mail: someone@rsm-games.com

Home | About Us | Contact Us | Product List | Service List | Calendar | Project List | Related Links | Product List

Fig. 7E

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

711

TO CONTACT US CALL: 1-555-555-5555

MY TOURNAMENT SETUP

MY TOURNAMENT 1 (MYT1)

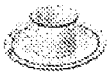

Invited / Eligible Players: Austin Gamers

When: 0001 June 25, 2011—2359 June 26, 2011

Where: Winstar, OK

EGMs: All Winstar EGMs

Prizes / Entry Fees: 1st Place: 50% ; 2d Place: 25%; 3d Place 15% (of Total Entry Fees / Winners determined by point totals); Note: Minimum entries: 5 (if min not met, entry fees returned by cashable credit to OURJACKPOT or WINSTAR player club account)

Signup: At any Winstar MGAM slot, enter tournament: MYT1 ; your username, & password ; entry fee: $10

Sponsor: None

> Cancel Tourny Entry Fee: $10

MY TOURNAMENT 2 (Enter a Title)

Invited / Eligible Players: (Select players from the drop down groups or create your own group by entering a group name & player names/emails in the popup fields. Default is ALL)

When: (Enter the beginning and end of the tournament/competition—HHMM MM/DD/YYYY—HHMM MM/DD/YYYY

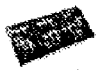

Where: (Select location from the drop down listing of enrolled locations & operators)

EGMs: (Select denom & manufacturers from drop down list. Default is ALL)

Prizes / Entry Fees: (Select from drop down list or create your own using the popup fields. Default is: 1st Place: $100, 2nd Place: $50, 3d place: $30 / $10 Entry Fee / 20 Player Minimum. In the event that the min Player requirement is not met, than all entries are returned via OURJACKPOT or Operator Player Club accounts as cashable credits)

Signup: (Select signup location from the drop down list. Default is OURJACKPOT account payment icon on OURJACKPOT Page (enter tournament title & entry fee requirement pops up to be paid) )

Sponsor: (Select from drop down list of enrolled sponsors. Default is None.)

> Submit Tourny Entry Fee: $(Auto-Populated)

Home | About Us | Contact Us | Product List | Service List | Calendar | Project List | Related Links | Product List

Fig. 7F

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

713

PLAY FOR FUN AND POINTS

Below are some of the games of our sponsoring manufacturers that you can play for fun and points --- just click and play. As you win, playing points are accrued to your OURJACKPOT account and may be accessed by sponsoring operators to screen players for special invitations. Top scores are listed on the leaderboards along with your unique three (3) digit player ID (established with your account & includes at least one non-letter symbol). Go for it --- earn your bragging rights!!

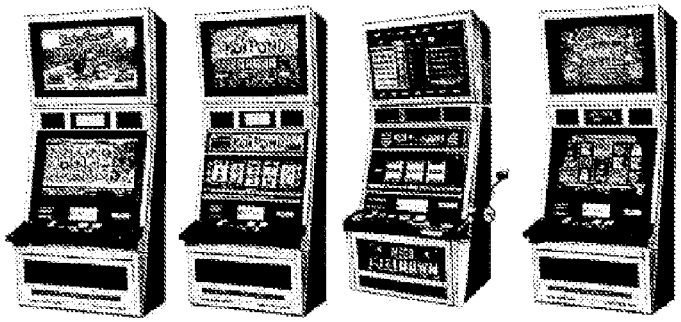

Home | About Us | Contact Us | Product List | Service List | Calendar | Project List | Related Links | Product List

Fig. 7G

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

Where social meets gaming – You set the rules – OURJACKPOT.com facilitates administration of each event, maintains scores in realtime

OURJACKPOT

715

LINKS TO OUR SPONSORS

Wynn Resorts

WWW.WYNNRESORTS.COM

Pinnacle Entertainment

WWW.PNKINC.COM

Pinnacle Entertainment, Inc. (NYSE:PNK) is a leading owner, operator and developer of casinos and related hotel and entertainment facilities.

Caesars Entertainment

WWW.CAESARS.COM

Caesars Entertainment Corporation is the world's largest casino entertainment company.

Multimedia Games

WWW.MULTIMEDIAGAMES.COM

Multimedia Games' innovations have pushed the gaming industry's technology envelope.

To contact us:

Phone: 555-555-5555
Fax: 555-555-5555
E-mail: someone@mm-games.com

Home | About Us | Contact Us | Product List | Service List | Calendar | Project List | Related Links | Product List

Fig. 7H

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

Where social meets gaming – You set the rules – OURJACKPOT.com facilitates administration of each event, maintains scores in realtime

OURJACKPOT

717

OUR JACKPOT MEMBER LOOKUP

Anderson, Pamela

Groups: World; Austin Gamers; Wynn Players Club

E-mail: panderson@OURJACKPOT.com More details...

Bardot, Brigette

Groups: World; Wynn Players Club

E-mail: bbardot@OURJACKPOT.com More details...

Dakota, Gene

Groups: World; GreenBayPackers; WisconsinBadgers

E-mail: gdakota@OURJACKPOT.com More details...

Gantry, Don

Groups: World; GreenBayPackers; WisconsinBadgers

E-mail: dgantry@OURJACKPOT.com More details...

Taylor, Elizabeth

Groups: World; Austin Gamers; Wynn Players Club

E-mail: etaylor@OURJACKPOT.com More details...

Home | About Us | Contact Us | Product List | Service List | Calendar | Project List | Related Links | Product List

Fig. 7I

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

719

ABOUT US

Multimedia Games' innovations have pushed the gaming industry's technology envelope. The giant strides we've made—in casino management, back-office systems development, new gaming systems, game introductions, innovative communications, networked technologies and player tracking systems—have helped position us as a leader in the world of interactive gaming systems.

Multimedia continues to evolve into a leading game content and systems provider, delivering games that players want to play and the tools to make them easy to run and easy to manage. Our technical innovations are driven by twin goals:

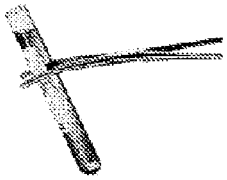

Caption describing picture or graphic.

- Deliver the best possible gaming experience
- Maximize profits for owners and operators We make is our business to understand our customers — and their customers — and challenge our developers to continue raising the bar in gaming systems and content design and development.

CLASS III EXPANSION AND COMMUNITY GAMING.

The Company is expanding into the Class III market with recent offerings such as the Community Bonus game Sport of Kings™, featuring a horse race-themed bonus that brings players together to compete against each other in a common bonus event that adds new elements and layers of excitement to the game.

TOURNAMENT PLAY.

The TournEvent tournament system, also new for the Class III market, transforms the old manual process of removing in-revenue slot machines from a casino floor and replacing them with tournament-only games into a live action slot theater with real time leader boards and countdown action broadcast on every machine and overhead display.

To contact us:

Phone: 555-555-5555
Fax: 555-555-5555
E-mail: someone@mm-games.com

Home | About Us | Contact Us | Product List | Service List | Calendar | Project List | Related Links | Product List

Fig. 7J

- Home
- MY JACKPOT PAGE
- MY TOURNAMENTS
- MY LEADERBOARD
- MY CALENDAR
- TOURNAMENT SETUP
- PLAY FOR FUN n
- OUR SPONSORS
- MEMBER LIST
- About Us
- Contact Us

WWW.OURJACKPOT.COM

OURJACKPOT

Where social meets gaming – You set the rules – OURJACKPOT.com facilitates administration of each event, maintains scores in realtime

721

CONTACT US

MULTIMEDIA GAMES INC.

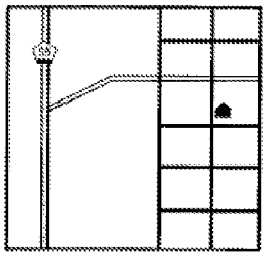

206 Wild Basin Rd, South

Austin, TX 78746

To contact us:

MULTIMEDIA GAMES INC.
WWW.MULTIMEDIAGAMES.COM

Multimedia Games, Inc.
206 Wild Basin Rd, South
Austin, TX 78746

Phone: 555-555-5555
Fax: 555-555-5555
E-mail: someone@mm-games.com

Home | About Us | Contact Us | Product List | Service List | Calendar | Project List | Related Links | Product List

Fig. 7K

PERSONALIZED JACKPOT WAGERING GAME, GAMING SYSTEM, AND METHOD

CROSS-REFERENCE TO RELATED APPLICATIONS

This application is a continuation-in-part of U.S. patent application Ser. No. 13/239,171, filed Sep. 21, 2011, now U.S. Pat. No. 8,602,877 and entitled "TOURNAMENT GAME, GAMING MACHINE, GAMING SYSTEM AND METHOD WITH A PLAYER-INTERACTIVE BONUS FEATURE" which claims the benefit of and incorporates by reference U.S. Provisional Patent Application Nos. 61/388,598 and 61/406,019, respectively filed Sep. 30, 2010 and Oct. 22, 2010, of the same title.

This application is also a continuation-in-part of U.S. patent application Ser. No. 13/232,900, filed Sep. 14, 2011 now U.S. Pat. No. 8,342,957 and entitled "CONVERTIBLE IN-REVENUE AND OUT-OF-REVENUE GAMING SYSTEM AND METHOD WITH A REAL-TIME PLAYER DASHBOARD DISPLAY" which claims the benefit of and incorporates by reference U.S. Provisional Patent Application Nos. 61/388,596 and 61/406,035, respectively filed Sep. 30, 2010 and Oct. 22, 2010, of the same title.

This application is also a continuation-in-part of U.S. patent application Ser. No. 12/818,402, filed Jun. 18, 2010, and entitled "WAGERING GAME, GAMING MACHINE AND NETWORKED GAMING SYSTEM WITH CUSTOMIZABLE PLAYER AVATAR", which claims the benefit of and incorporates by reference U.S. Provisional Patent Application No. 61/321,406 filed Apr. 6, 2010.

The applicants hereby claim the benefit of each of these prior U.S. provisional and nonprovisional patent applications. The entire content of each of these prior U.S. provisional and nonprovisional patent applications is incorporated herein by this reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent files or records, but otherwise reserves all rights of copyright whatsoever.

BACKGROUND OF THE INVENTION

1. Field of the Invention

This invention relates to wagering games, gaming machines, gaming systems, and associated methods. More particularly, the invention relates to wagering games, gaming machines, systems, and related methods wherein a player, user or casino operator may define one or more game events or attributes such as: an invitational tournament with one or more award types (e.g. fixed or progressive) or paytables, an eligible set or group of players (e.g. close group of friends, employees of a selected company, members of a club), eligibility criterion (e.g. play within a selected period, a threshold amount of cumulative play, one or more types of games (i.e. Multimedia Games Meltdown®, Bally's Blazing 7s®, etc)), a funding mechanism (e.g. player or sponsor contributions or portions of eligible player wagers), and/or a triggering mechanism for winning the award (e.g. random based on a game outcome, matching a random number with a first number, achieving a single or cumulative highest score, etc.). The game events or attributes may be defined by the player, user, or casino operator on-site at a casino or online through a website connectable with one or more casinos.

2. Description of the Related Art

Various gaming systems have been developed to provide gaming machines and systems with interesting games or variations. There continues to be a need for innovative methods and gaming systems which provide players with more personalized games or awards.

SUMMARY OF THE INVENTION

In accordance with one or more embodiments of the present invention, a gaming system method includes a personalized tournament or group event hosting website wherein players interested in participating in or organizing one or more groups and/or associated group events online or at participating casinos, may register with the website, establish a website identity and account, join and establish groups, invite friends and acquaintances to join one or more groups, accept and extend invitations to play in tournaments or competitions, and, set up and enter tournaments or competitions. The personalized tournament hosting website may be accessible through players' PCs, cellular phones, tablets, kiosks or gaming machines.

In one or more embodiments, the group event information may be accessed by or transferred to a designated casino facility server which may transfer and receive group event information as between the selected gaming machines, and function as the group tournament or community event host. In other embodiments, an external server hosting the website may be communicably connected or linked to the selected gaming machines and/or a facility tournament/competition server and function as the group tournament or community event host.

In one or more embodiments, the selected gaming machines include a group-player login interface enabling the group member to be identified as participating in or competing for one or more of the particular group's events or awards. In the event that the group-player is a member of two or more groups, the player interface may provide an option to elect which group event or award that the player wishes to compete in or for. In one or more embodiments, the group server may enable a group-player to participate or compete in two or more group events or competitions. In such case, depending upon the event or competition funding format, a player may be required to pay an additional fee or make an additional wager. Alternatively, a handle contribution may be divided between the several competitions with an associated tradeoff, such as dividing the likelihood of a competition win or dividing the number of game points or credits accrued in the primary game by the number of competitions being played for by the player in accordance with the rules of the respective events or competitions.

These and other advantages and features of the invention will be apparent from the following description of preferred embodiments, considered along with the accompanying drawings.

BRIEF DESCRIPTION OF THE DRAWINGS

FIGS. 7A-7K illustrate an example set of web pages of a personalized competition and tournament website (Ourjackpot.com) as in FIG. 1 wherein visitors may register and setup and/or enroll in tournaments and/or competitions in accordance with one or more embodiments.

DETAILED DESCRIPTION OF PREFERRED EMBODIMENTS

Figure 1:
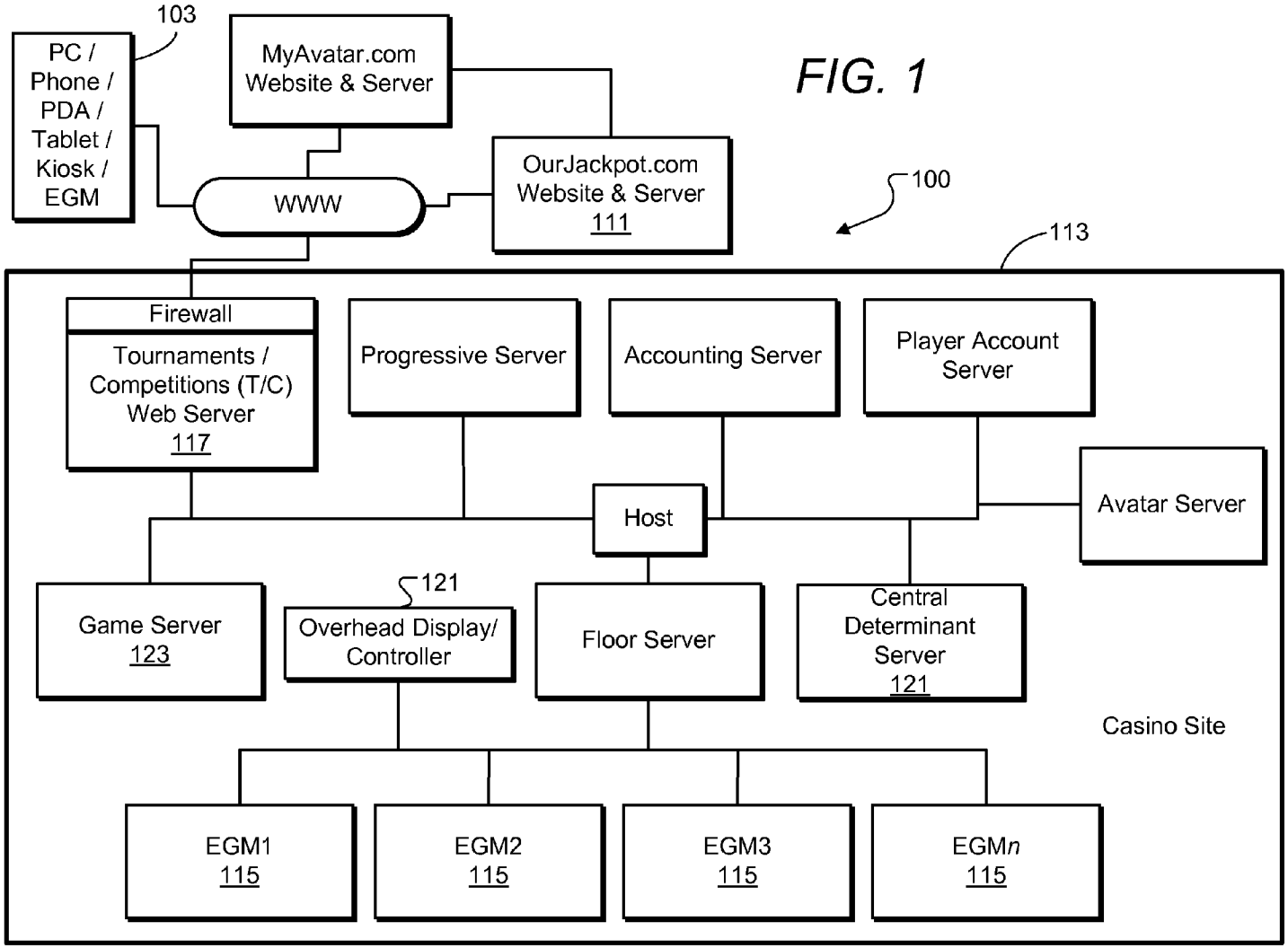
FIG. 1 illustrates an example block diagram of an example networked gaming system including a personalized competition and tournament website wherein players may establish and enter personalized competitions and tournaments and participate in the competitions and tournaments while playing gaming machines in accordance with one or more embodiments.

Referring to FIG. 1, networked gaming system 100 is shown to include personalized competition and tournament website 111 connected to casino site 113. Players may establish and enter personalized competitions and tournaments through website 111 and participate in the personalized competitions and tournaments while playing gaming machines 115 associated with casino site 113 in accordance with one or more embodiments.

Website 111 (e.g. www.Ourjackpot.com) may be hosted by a website server internal or external to networked gaming system 100 connectable to casino site 111 through the world-wide-web (WWW) or similar communications network. For example, the server for website 111 may connect to tournaments/competitions (T/C) server 117 through a firewall in order to provide security to and access (such as through a secure channel) by networked gaming system 100, so that T/C server 117 may obtain player and tournaments/competitions information stored or associated with website 111 which may include one or more player group associations with which a player may be identified. Additional information that may be accessed or provided may include one or more favorite games and/or associated points obtained from wagering or non-wagering gaming activity at one or more gaming facilities or online. In one or more embodiments, T/C server 117 or its software may be provided by a gaming manufacturer for simultaneously connecting to one or more T/C enabled gaming machines 115 at casino site 113 and website 111 or its server for transferring T/C and player content.

For example, a player may access a website, such as Ourjackpot.com (which may or may not be associated with a particular gaming machine manufacturer or gaming operator) (See e.g. FIG. 7A-7K), wherein one or more selectable options provide the player (group manager) with an option to create a group by inputting a group name and populating the group, such as by manually inputting group member names and information or by importing data from one or more databases which may be associated with one or more websites, such as MySpace.com, Facebook.com, Twitter.com, ChatRoulette.com, Linkedln.com, Local_Bowlers.com, Yahoo-.com, MicrosoftOutlook.com, or other databases stored or accessible through the player's personal computer or data device. Members in one or more groups may participate in one or more tournaments or community events specific to the particular groups with which the members are associated. The tournaments or community events for a particular group (e.g. a group that has been named "Laura's Bowlers") may be set up by the group manager through the Ourjackpot.com website and members of the group may participate in the tournaments or community events in accordance with any rules that may be established by the group manager. In some instances, the group manager may set up a particular day and times in which group members may participate in the tournament or community event. In other instances, the tournament or community event may be scheduled over one or more days, weeks, months. In yet another instance, group members may be offered instant competitions or tournaments (such as a Pop It™ competition wherein a group member is provided an opportunity to post a score on the Ourjackpot.com website based on the number and size of random balloon appearances and player pops during a period). In one or more embodiments, group members selected to be part of the group may be sent an invitation from the player through Ourjackpot.com (e.g. via email, voicemail, text, twitter), have an opportunity to accept or decline the invitation, and, upon acceptance, receive a password enabling them to participate in associated tournaments or community events.

In one or more embodiments, group members may participate in tournaments or community events while online through Ourjackpot.com or at one or more selected gaming operator's facilities (e.g. a casino or a local grocery or convenience store offering gaming machines) or gaming manufacturer's machines (e.g. Multimedia Games gaming machines). Passwords may be used to restrict participation in various group tournaments or community events to group members of the respective group. For example, when a given group tournament or community event is requested by a player at a playing station (i.e. gaming machine, gaming tablet, PC, handheld phone, etc.), that player may be prompted for a password to enable access to the event. In addition to restricting group events to group members and selected locations, group events may also be restricted to types of games or gaming machines (e.g. one or more of Multimedia Games® Tournevent® banks, selected Multimedia Games® gaming machines and game titles, selected denomination slots (e.g. penny, nickel, quarter, dollar, etc.), each of which is connected to a host computer to receive and/or transmit information about the group event and game play at the respective gaming devices or machines).

In one or more embodiments, a group manager (e.g. any or selected registered users of Ourjackpot.com) may be provided options, while connected to the Ourjackpot.com website, to: a) designate the criteria for winning one or more group event awards (e.g. jackpots) or prizes, and b) designate which of one or more players and/or organizations (e.g. charities) may be awarded one or more of the awards or prizes upon meeting the criteria. The group manager may also be provided the option to select a group password or the group password may be determined by the Ourjackpot.com website server, such as through a random number generator.

In one or more embodiments, the Ourjackpot.com website may send a periodic email to group members wherein they may be informed of the status of any awards or prizes (e.g. the amounts and, if an award or prize has been won, who the winner was, when the win occurred, and where the win occurred), the names of locations (e.g. casinos), where they may find the games to play to compete for the group event awards or prizes, and other information and/or advertisements that may be of interest to group members.

In one or more embodiments, one or more casinos or facilities may have gaming machines or devices 103 (e.g. conventional slant or upright gaming machines or alternatively, tablets, cell phones, or communication devices connectable to an intranet or internet website with games or gaming functionality) with a topper, logo and/or informational field informing players of the availability of the Ourjackpot group events and a group player login interface, such as a touchscreen LCD or display and keyboard, enabling the player to participate in one or more group events. Upon logging in with a username and password, the player information may be transmitted by the player's gaming machine 103 to a group server, such as Web Server 111, which may include Ourjackpot programming executable to access a local or remote database, determine which group or groups the player information is associated with, identify any active group events, and transmit the group event information associated with the player to the player's gaming machine 103. Upon receipt of the group event information, the player's gaming machine 103 may display the group event information, such as on a top box display, side window portion of the primary display where the primary game may be displayed on another portion of the primary display (e.g. IGT Service Window), or a player interface unit display (e.g. Bally iView®). The displayed group event information may include a listing of the awards or prizes, player standings in the group event such as any current or past winners, any accumulated point totals (if a point-based competition), and the criteria for winning respective of the awards or prizes (such as a random number match, a specified threshold number of accumulated points, a particular winning outcome (e.g. 5 of 5 Multimedia Games® Cherries symbols) on an active (wagered upon) 5-reel payline, or the highest point totals at the expiration of a specified period (e.g. 0001 Dec. 24, 2010-1200 Dec. 26, 2010). For instance, points may be accumulated by a player as a function of total wagers, total winnings, or a combination thereof.

For example, once the player is logged in, the player interface display may display: "Welcome, [player's name]. You have received X amount of winning credits from previously won group jackpots. Your current group jackpot is now at Y amount and the World group jackpot is now at Z amount" (where the World group jackpot may be an overall large jackpot contributed to by each of the groups associated with Ourjackpot.com). (See e.g. FIGS. 2A, 2B, 3A, and 3B).

Figure 2A:
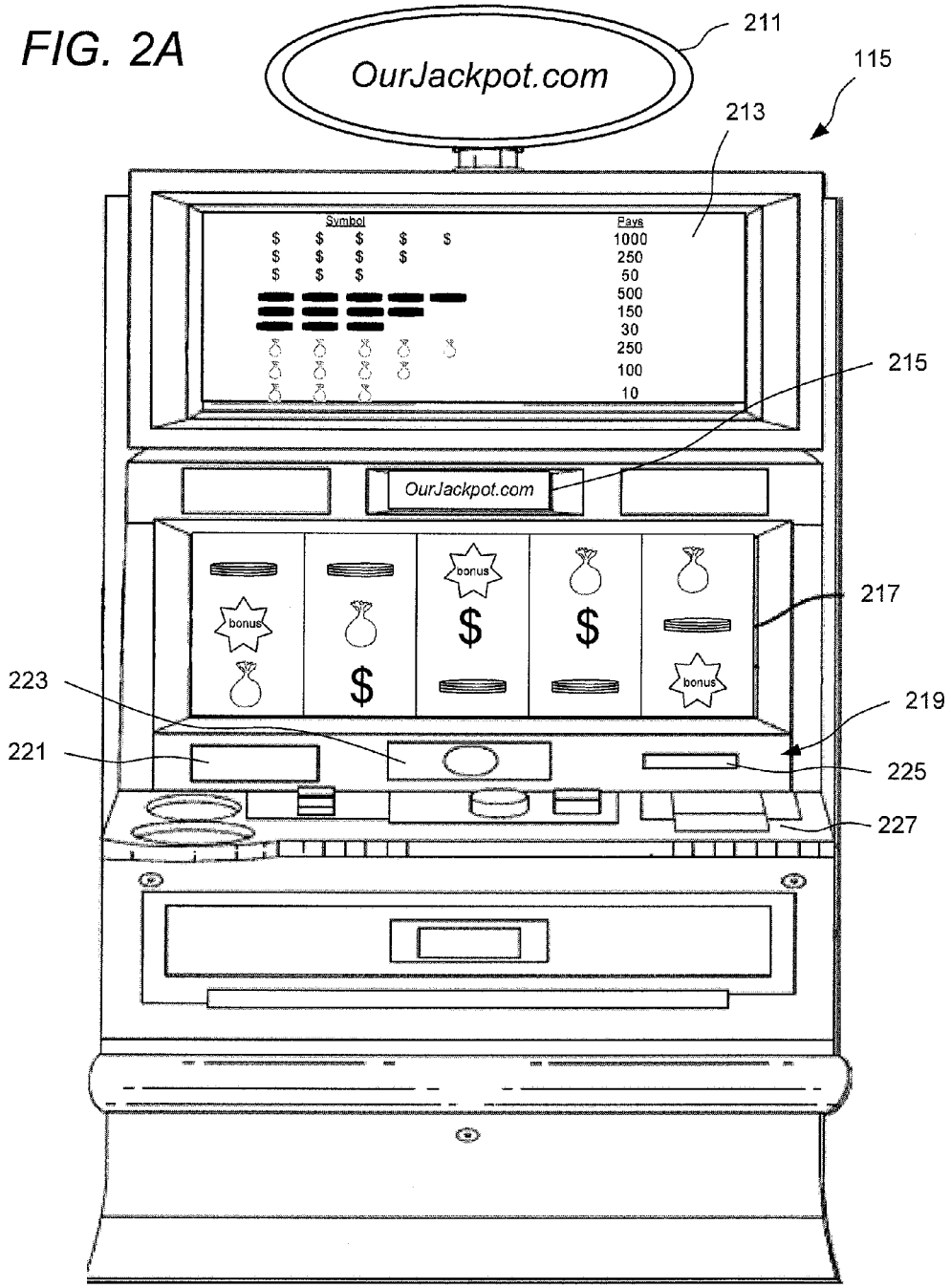
FIG. 2A illustrates an example gaming machine including a competition result/current prize display in accordance with one or more embodiments.
Figure 5A:
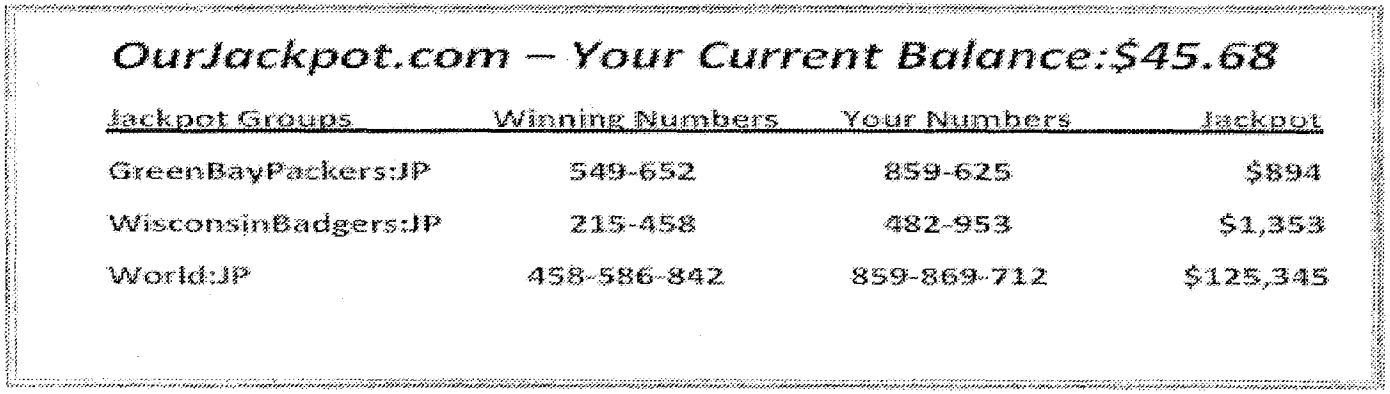
FIGS. 5A and 5B illustrate alternative real-time personalized competition result/current prize displays, respectively, such as may be shown on the player tracking display of the gaming machines of FIGS. 2A and 2B respectively.

In one or more embodiments, as the player plays the primary game, one or more sets of winning numbers may be randomly generated for the player, either through the gaming machine or the group server, and displayed on one of the displays, such as the player interface display (see e.g. FIG. 2A, 5A). For example, each handle pull or wager by a player on the primary game may trigger the generating or drawing of three different sets of winning numbers. Each set of winning numbers may be matched by the player's gaming machine or the group server with a respective one of the group jackpots to determine if the player has won the particular group jackpot. When a win occurs, the player's gaming machine may provide a winning audio/visual presentation through at least one of its displays and speakers. In some cases, payment of an award may be completed through the player's gaming machine 103, through crediting of the player's account either at the facility or online (e.g. in association with the Ourjackpot.com website), or through a handpay by a representative of the facility operator where the player's gaming machine 103 is situated.

In one or more embodiments, as the player plays, the group information display may be updated on the player's display and the player's updated information may be transmitted to the group server which may transmit updated group information to each gaming machine 103 with an identified group member player on a real-time or periodic basis. In the event that the player wins an award or prize during game play, then the award or prize may be paid in accordance with the terms of the group event and the player's gaming machine may display a winning presentation. The winning presentation may also be transmitted for display on overhead display 121 (FIG. 1). Additionally, the player's winning information and/or a winning presentation associated with the winning player may be transmitted to the group server for display at the other group members' gaming machines 103.

In one or more embodiments, the winning player may be awarded a substantial portion but not all of the group jackpot (e.g. 90%) and the remaining portion may be apportioned equally amongst the other group players. In some cases this apportionment may be limited to the group members playing on other gaming machines at the time of the winning jackpot event. In another example, the jackpot may be designated to be paid to a charity, so that when the player wins the group jackpot, the designated charity is awarded the substantial portion of the group jackpot and the remaining portion is apportioned amongst each of the group members. In this case, the winning player may be awarded a larger apportionment than the other group members and the apportionment may, in some cases, be limited to the group members who are playing at the time of the winning event. In the event that non-playing group members are included in the apportioned award, then a record may be retained such as by the group server in association with each of the respective non-playing group members and on the next occasion when respective of the non-playing group members login at participating gaming machines 103, the apportioned award may be downloaded to the respective gaming machines and credited to the respective players, or otherwise awarded to the respective players. In one or more cases, there may be a time limit (e.g. 3 months) for retaining the awards on the group server at which point the amounts may revert to the facility operator and the respective records purged from the group server associated database. Alternatively, the unclaimed amounts may revert to the respective group jackpot pool. In some instances, the non-playing group members may each be sent a notification such as a text message or email advising the member of the jackpot win and that they have been awarded a portion which may be collected on the next occasion when they login at a participating gaming machine 103.

In one or more embodiments, an initial seed group jackpot may be provided by the Ourjackpot.com provider (e.g. a gaming machine manufacturer or gaming operator), such as when first starting a group jackpot or after a winning jackpot. Where initial seed group jackpots are used, various mechanisms may be used to recover the seed amount. In one instance, as players play the group event, a portion of the wager may be paid to or set aside for the seed amount provider. In another instance, if the seed provider is a casino operator where the group event is being held, then the casino operator may simply act as a sponsor and absorb the cost through its operations. In another instance, the Ourjackpot.com operator may simply act as a sponsor and absorb the cost through its operations; for example, if Operator X is the Ourjackpot.com operator, it may limit eligible gaming machines for Ourjackpot.com group play to certain manufacturers or gaming machines upon which Operator X receives some compensation (e.g. revenue sharing with a casino facility operator, such as 2% of wagers and $30 per gaming machine with the Ourjackpot.com feature, in which case Operator X may contribute a percentage (e.g. 1%) of its compensation to the group jackpots). Alternatively, Operator X may receive a lump sum compensation from the casino facility operator for providing the Ourjackpot.com feature on selected gaming machines and facilitating the group events. In one instance, to build the size of the progressive group awards, a percentage of the wagers of the group members may be accrued (e.g., at 1% per wager) and apportioned between the number of group progressive awards (e.g. the group progressive jackpot and group World progressive jackpot). In another instance, the casino operator may increment the size of the progressive awards based on its own determination. In yet another instance, each group player may contribute an amount either one time or on multiple occasions (e.g. contribute $10 during every four hours of play, and if the player doesn't ante up the contribution amount when prompted, then the player may be logged off from the group event). In other instances, there may be a combination of mechanisms utilized to fund and grow group progressive awards. In the case of large awards, such as may be accrued through a group World progressive jackpot, payment may be annuitized so that payment to a winning player may be made over a term (e.g., 20 years) and the payor (e.g., the Ourjackpot.com operator) may accrue the interest associated with the award.

In an example embodiment, the Ourjackpot.com website may support the adoption of individualized group player avatars which when selected by group players may be associated with the player information, such that upon login at a gaming machine with the Ourjackpot.com feature, the player's personalized avatar may be displayed and interact with the player during the course of game play such as is described more fully in U.S. patent application Ser. No. 12/818,402, filed Jun. 18, 2010, and entitled "WAGERING GAME, GAMING MACHINE AND NETWORKED GAMING SYSTEM WITH CUSTOMIZABLE PLAYER AVATAR".

In another example embodiment, when a group manager sends an invitation to join a first group to an individual, the individual may accept the invitation, and, if permitted by the group manager, invite others to join the group. A group member may also begin or join one or more other groups, and one or more of such other groups, may be enabled to participate with one or more group events or competitions of the first group (and/or vice versa). For example, one group manager may ask to enable its group to participate with a second group's events or competitions. Such joint participation of one group with another group may be limited to a single event or competition, multiple events or competitions, or all events or competitions of the other group. The relationship may be one-way (such that a first group may participate with a second group's events or competitions, but not vice versa) or mutual (such that both groups may participate with the other group's events or competitions).

In another example embodiment, the Ourjackpot.com operator may include options that may be limited to a selected casino operator and may also include advertising associated with the casino operator and its facilities along with a selectable button link to the websites of the casino operator and/or its facilities. For example, the selected casino operator may act as a group manager and send an invite to a selected group of patrons to participate with the group and various group events. If the casino operator owns facilities in various jurisdictions, the casino operator may select one or more of the facilities from a given jurisdiction as the venue for the group events and may elect to establish a group limited to those venues; and, the casino operator may elect to establish another group for another jurisdiction, and so forth. In some instances, each or selected invitees may be provided the option to invite others to join in the group. As an initial kick-off, the initial group invitees may be limited to top tier patrons and various additional incentives may be provided by the casino operator including special awards and prizes.

Figure 2C:
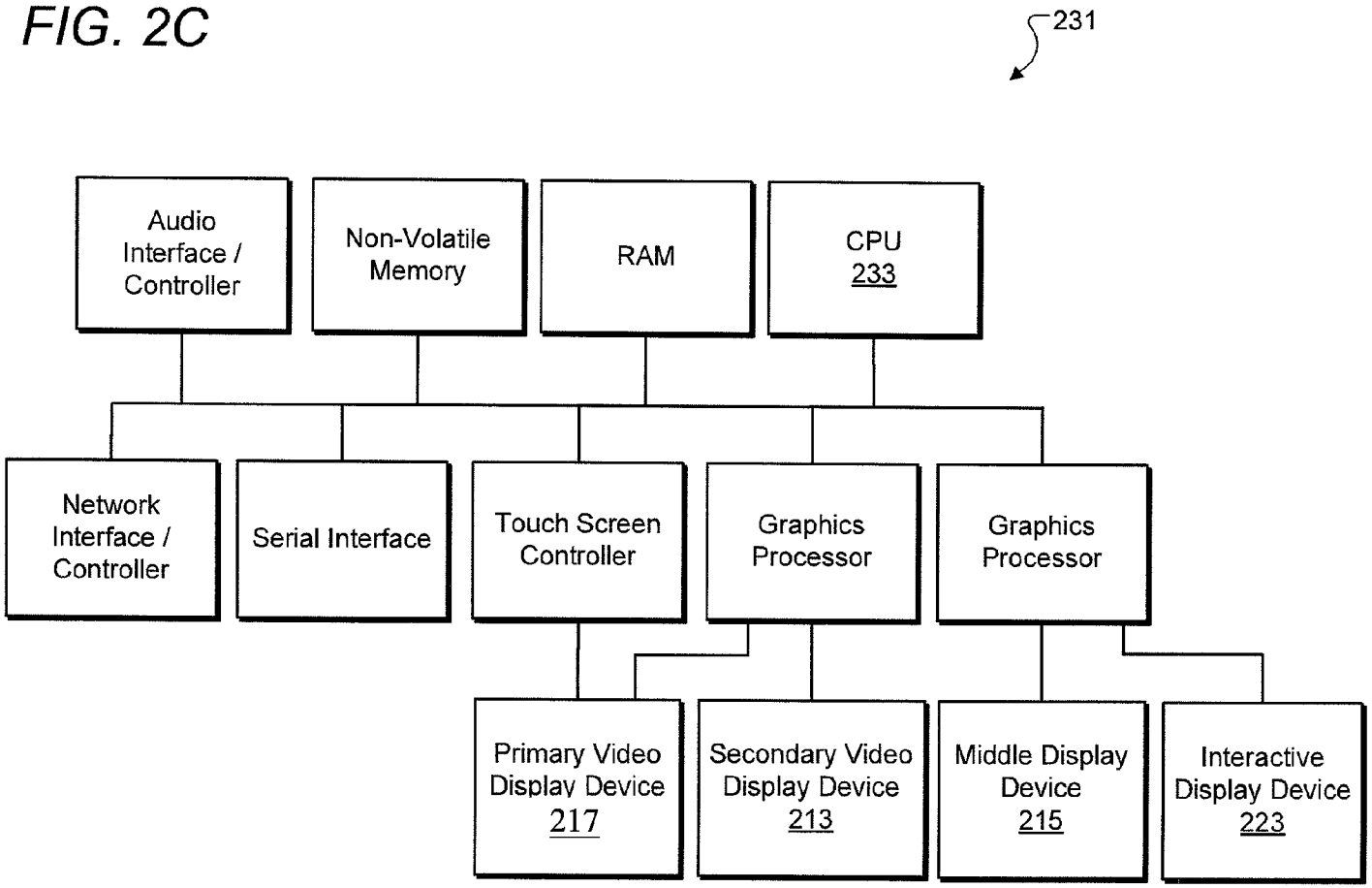
FIG. 2C illustrates an example logical block diagram of a gaming machine processor and devices as in FIGS. 2A and 2B.
Figure 3A:
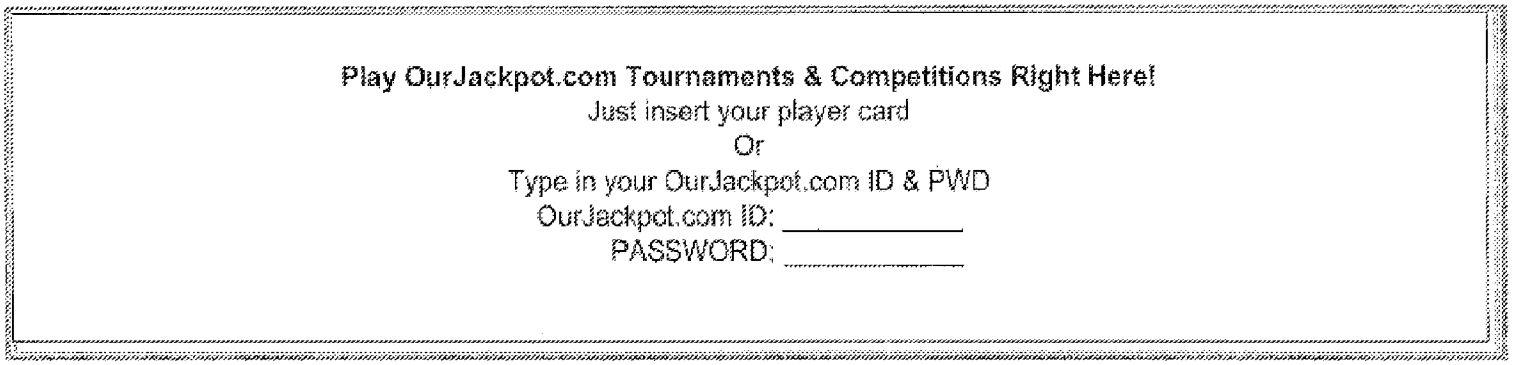
FIGS. 3A and 3B illustrate a sequence of personalized competition sign-in and competition result/current prize displays, respectively, such as may be shown on the player tracking display of the gaming machine of FIG. 2A.
Figure 3B:
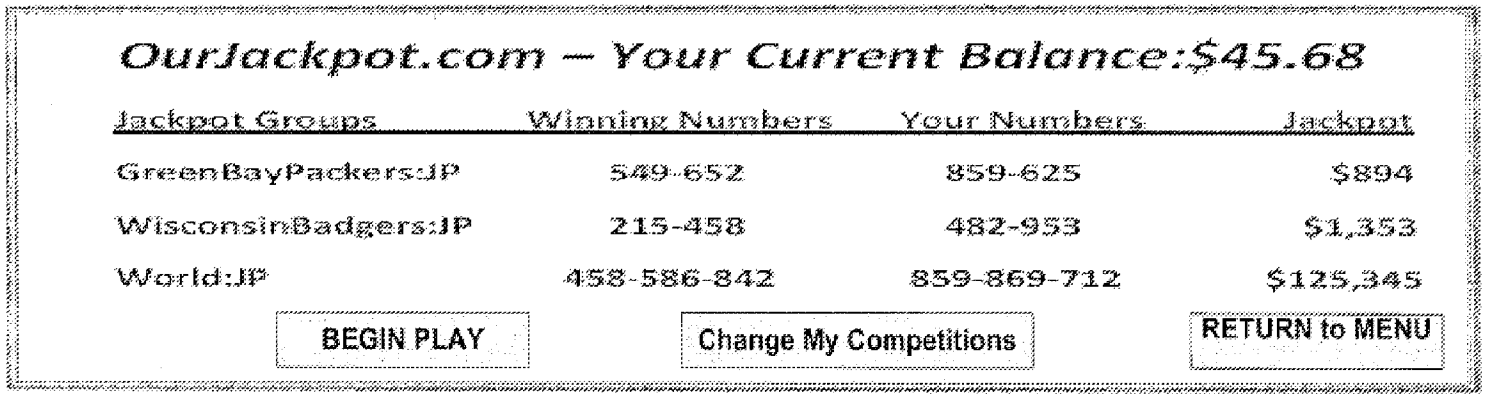
Figure 9:
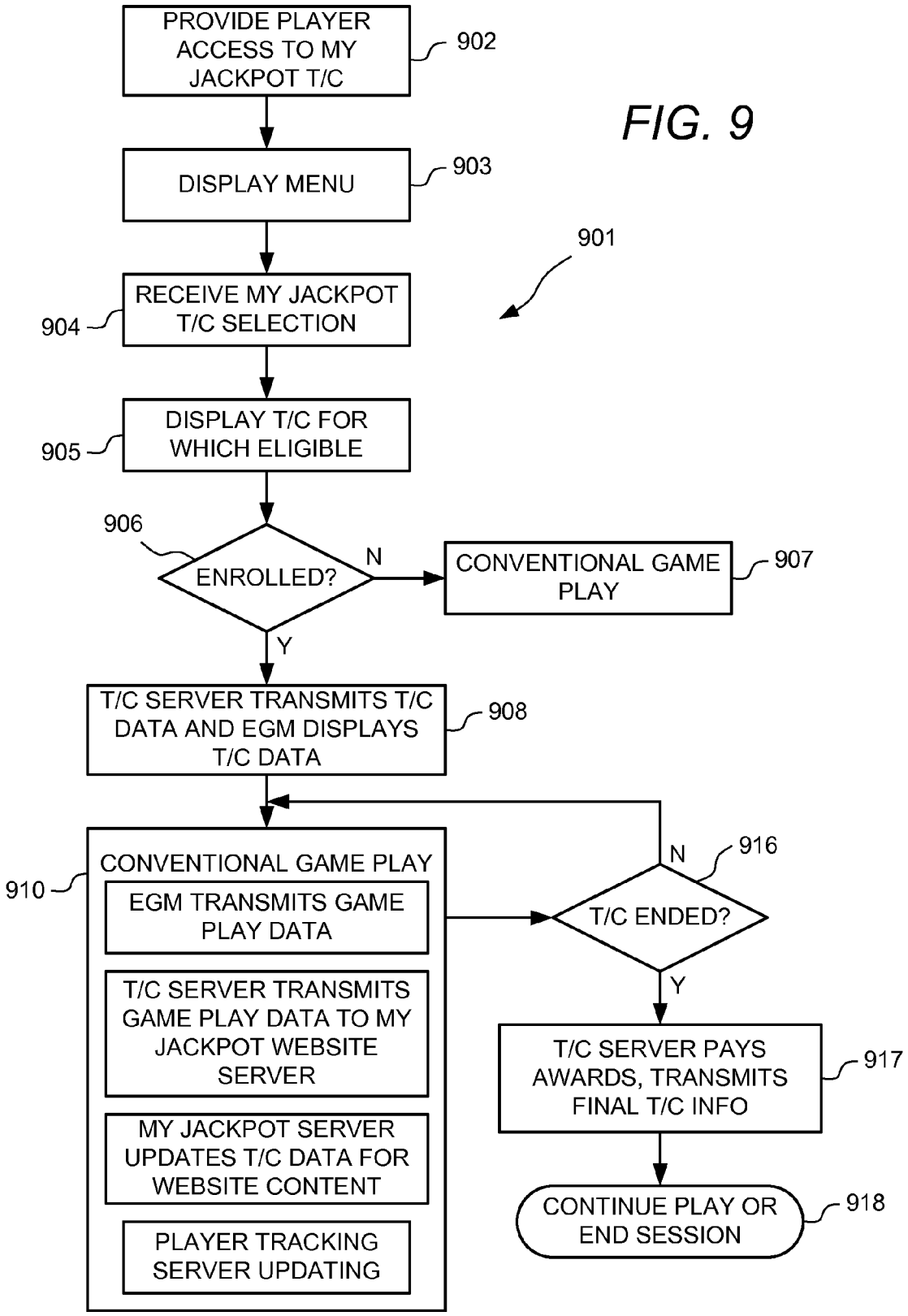
FIG. 9 illustrates an example flow diagram of a personalized tournament/competition as may be played on the gaming machine of FIGS. 2A and 2B through a network-connected gaming system as shown in FIG. 1.

Referring to FIG. 2A, example gaming machine 115 is shown including topper 211 with personalized T/C logo (e.g. Ourjackpot.com), upper display (top glass) 213 with a paytable displayed, middle mini-display 215 with personalized T/C logo displayed, display 217 with primary game displayed (e.g. 5 reel video game), player interface unit (e.g. Bally iView®) 219 with bill acceptor 221, interactive player display 223, and card reader 225, and button deck 227 with lines, credits per line, play, and cash out buttons in accordance with one or more embodiments. Internally, one or more printed circuit boards including at least one processor (e.g. Intel Pentium® or Core® microprocessor) are installed to operate the game or games associated with the gaming machine, drive the displays and various components/peripherals associated with the games, and, connect over the gaming network to communicate with respective of the back-end servers (e.g. T/C server 117 shown in FIG. 1). Example logical block diagram 231 is shown in FIG. 2C. Example process 901 of gaming machine 115 in conjunction with one or more personalized tournaments or competitions is shown in FIG. 9 wherein a player may initiate or continue T/C play such as by designating T/C play on player interactive display 223 and playing the primary wagering game displayed on display 217. Examples of displayed information on interactive player display 223 are shown in FIGS. 3A, 3B, and 5A. During a gaming session, display 223 as shown in FIG. 5A may be updated to display current jackpots, randomly generated or selected player numbers ("Your Numbers"), and randomly generated winning numbers ("Winning Numbers") for each competition. In one or more embodiments, once a player initiates a primary game play, a signal may be transmitted over the network to T/C server 117 which may responsively randomly generate the player numbers for each of the competitions and transmit the generated player numbers along with the winning numbers and updated jackpot amounts to the respective gaming machine 115. If one or more of the player numbers match the corresponding winning numbers, then the player wins the corresponding jackpot which may be paid by gaming machine 115, hand paid by staff of the respective operator, paid by T/C server 117 to a corresponding player account, or paid by personalized T/C website 111 (and/or its server) to a corresponding personalized T/C website account.

Figure 2B:
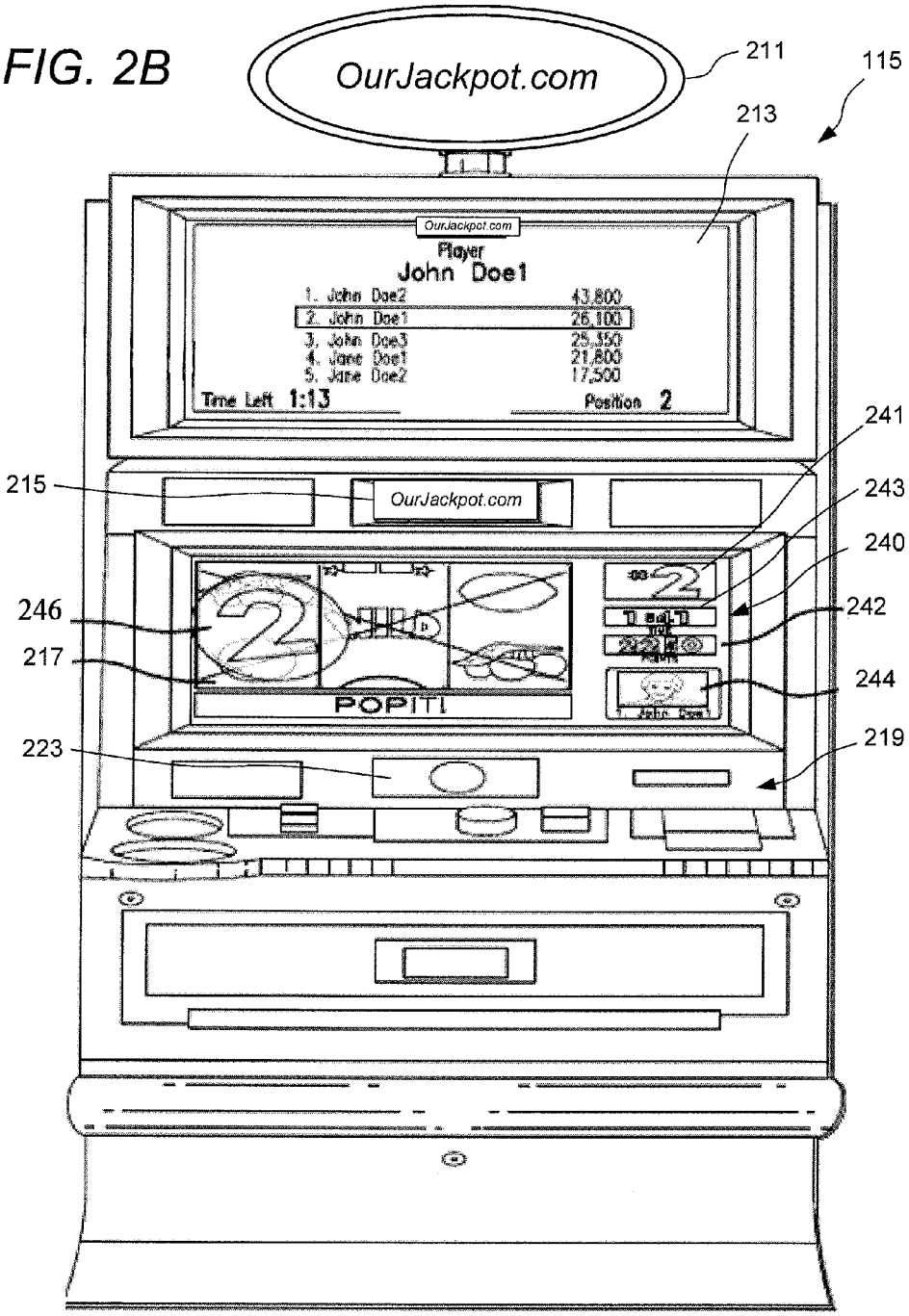
FIG. 2B illustrates another example gaming machine including personalized competition leaderboard, player position/score, and competition result/current prize displays in accordance with one or more embodiments.

Referring to FIG. 2B, another example gaming machine 115 is shown in accordance with one or more embodiments whereon upper display 213 displays a personalized tournament or competition leaderboard with real-time updates from T/C server 117, display 217 displays a primary game and a side panel 240 with the player's real-time position 241, score 242, and time remaining 243 in one or more tournaments or competitions (which may be collectively displayed or displayed sequentially in the case of multiple T/C player participation) plus a video picture 244 captured by a video camera (not shown) which may be included with each gaming machine 115 and which may additionally be displayed on an overhead display (see e.g. FIG. 6) and/or on personalized T/C website 111. In the example of FIG. 2B, interactive display 223 displays real-time updates of one or more personalized tournaments and/or competitions in which the player is participating, the player's current respective scores and position, and respective jackpots. In one or more embodiments, as the player plays the primary game, the player may obtain points for the various competitions or tournaments according to the rules of the respective tournaments (see e.g. FIG. 5B). The accumulated points may be determined locally by the gaming machine (as for instance through a network controller programmed to make the calculations) or determined remotely (as for instance the player's gaming activity may be transmitted to T/C server 117 which may be programmed to determine the amount of the player's accumulated points and transmit updated personalized T/C data to the respective gaming machine). In one or more embodiments, a game may be displayed on display 217 which may be part of or separate from the primary game and wherein a player may press on balloons 246 when they appear to obtain enhanced, additional or special awards which may include monetary or non-monetary prizes (e.g. T/C points or promotional benefits such as free meals, accommodations, travel tickets, or sweepstakes tickets). Balloons 246 may appear before, during, and/or after primary game play and their appearance may have some correspondence to primary game play activity, or, alternatively they may appear at any time when a player's card is inserted and not abandoned. In one or more embodiments, points or scores obtained in the balloon game may be applied to each of the personalized T/C in which the player is participating or may be applied specifically to a popping balloon game competition or tournament.

Referring to FIG. 2C, example logical block diagram 231 of gaming machine 115 is shown together with processor (CPU) 233, associated memory including game programming, display controllers, serial interface, and network interface which may include a network controller and programming to facilitate collecting gaming information, transmitting gaming information, and receiving updated T/C information substantially in real-time. In one or more embodiments, the updating of the respective player points or scores may be performed by the network controller if programmed to do so. In one or more embodiments, T/C content on upper display 213 may be driven by the network controller.

Referring to FIGS. 3A and 3B, an example sequence of personalized T/C sign-in and result/current prize pages 311, 313, respectively, such as may be shown on player interactive display 223 of gaming machine 115 such as shown in FIG. 2A. For example, when a player inserts a player card or currency into gaming machine 115 with T/C capability, page 311 may be initially displayed or a preliminary page may appear with a welcome and include one or more options which the player may select, such as T/C. If T/C is selected then page 313 may be displayed. In cases where a player has included player card information on the personalized T/C website (e.g. Ourjackpot.com) and has inserted the player card into the card reader of gaming machine 115, then the player may be auto-identified with the player's T/C identification and page 313 may simply appear; otherwise, the player may need to enter the Ourjackpot.com ID/password in order to be recognized and permitted to play in one or more of the personalized T/C. Once identified, the player's T/C groups and/or T/C may be displayed on a page, such as page 313. Players may or may not be limited to the number of T/C groups and/or T/C with which they may be registered. In one or more embodiments, players may be limited to one, two, or three T/C in which they may compete simultaneously; in which cases, there may be a limitation imposed by T/C website 111 and/or gaming machines 115. In the instant case, page 313 displays three groups and provides for an option for the player to either begin play ("Begin Play"), change competitions such as by eliminating or adding T/C for which the player may be eligible to play ("Change My Competitions"), or return to a prior page menu ("Return to Menu") by selecting a corresponding interactive element.

Figure 4A:
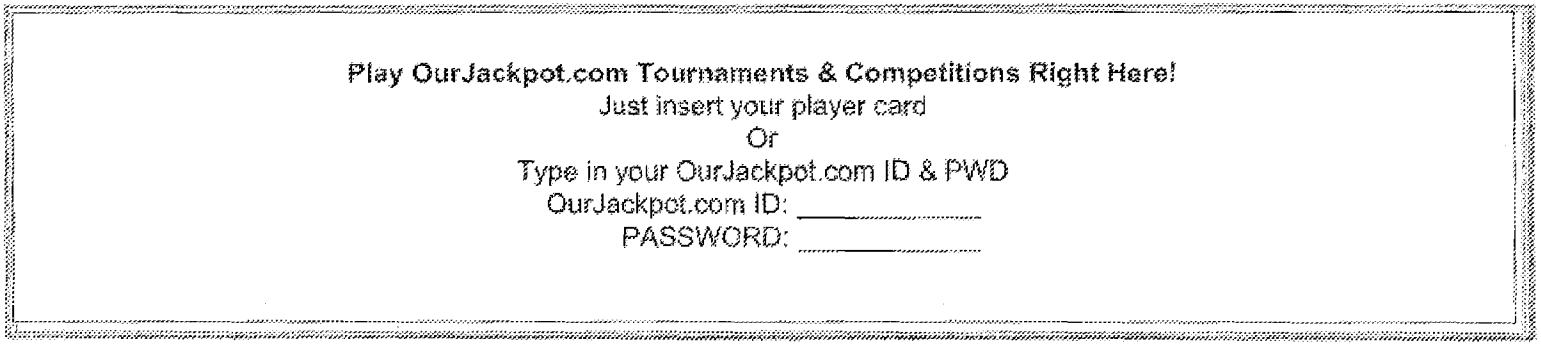
FIGS. 4A, 4B, and 4C illustrate a sequence of personalized competition sign-in, competition status/current prize, and competition enrollment displays, respectively, such as may be shown on the player tracking display of the gaming machine of FIG. 2B.
Figure 4B:
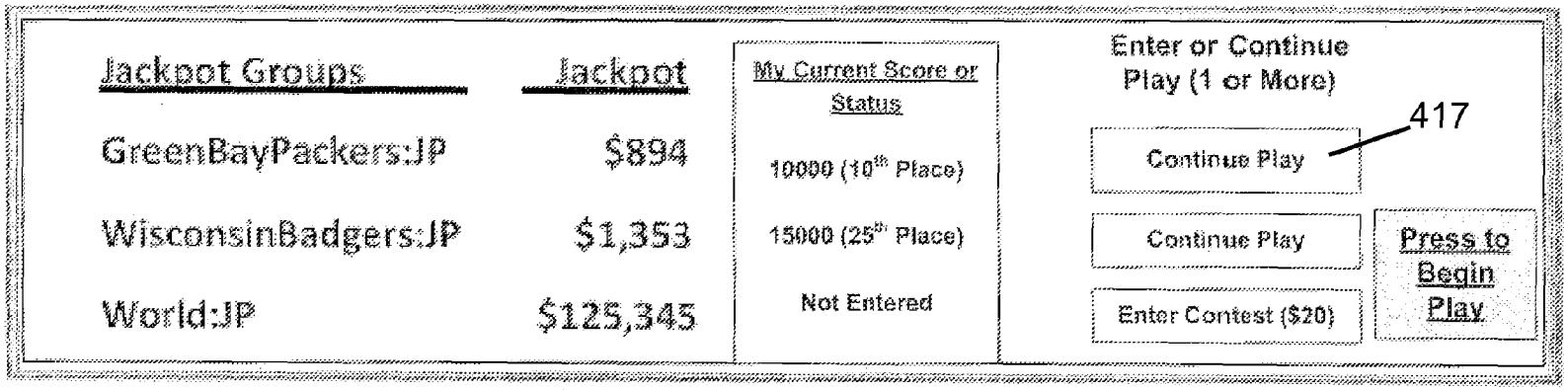
Figure 4C:
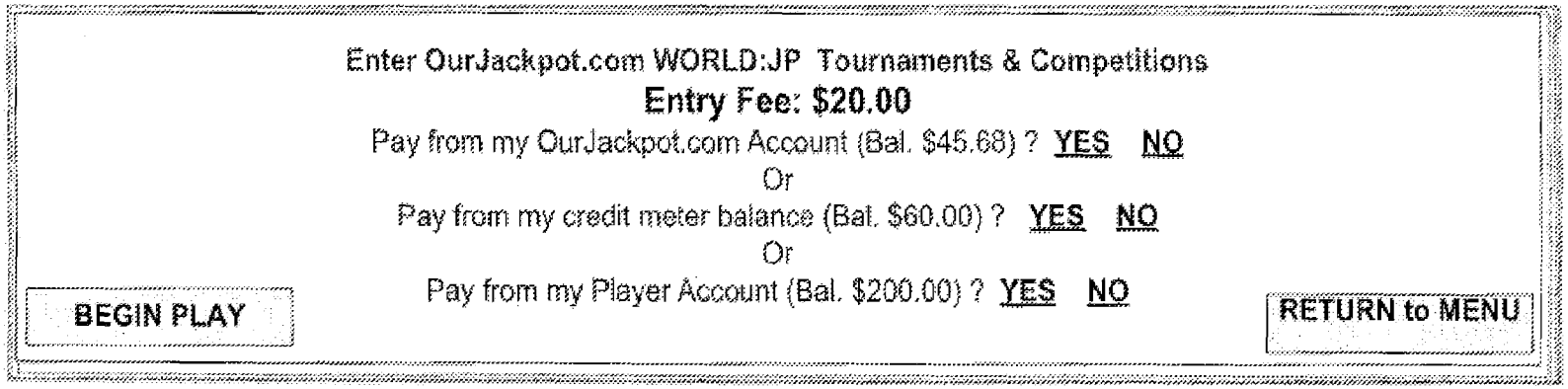

Referring to FIG. 4A, 4B, 4C, a sequence of personalized T/C pages 411, 413, 415 may be displayed on interactive display 223 of gaming machine 115 as shown in FIG. 2B. Pages 411, 413 correspond to pages 311 and 313, respectively, shown in FIGS. 3A and 3B, whereas page 415 in FIGS. 4A, 4B, and 4C shows an example page that may be displayed in the case where the player is required to enroll and pay an entry fee for a tournament (named "World:JP" in the figure) and provides selectable options for the player to make the payment such as through the player's OurJackpot.com account, the credit meter on the respective gaming machine, or the player's server-based account as may be stored and accessed on the player account server (see FIG. 1). The primary difference between pages 313 and 413 is the type of competition; in the case of page 313, a random matching game competition is shown whereas page 413 displays a point or score accumulation type competition or tournament with the player's ranking or placement for each ongoing T/C. Also, page 413 displays selectable elements 417 for continuing play or entering into selected of the displayed T/C.

Figure 5B:
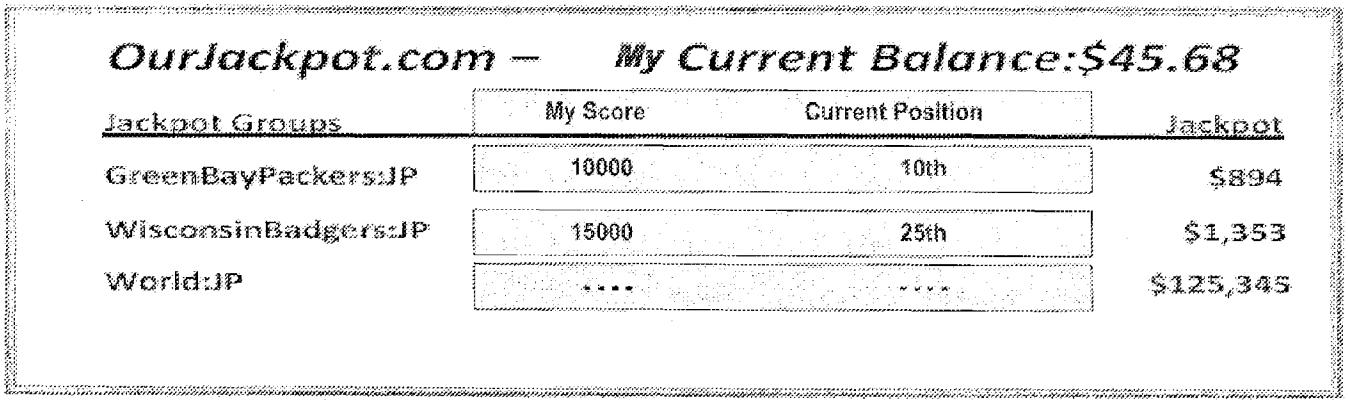

FIGS. 5A and 5B show example alternative real-time personalized competition result/current prize pages 511 and 513, respectively, as may be displayed on a display, such as interactive display 223 during the course of play on gaming machines 115 as shown in FIGS. 2A and 2B. In one or more embodiments, T/C server 117 may update the respective displays 511 and 513 in accordance with respective players' game play on a real-time basis responsive to gaming data collected from respective of gaming machines 115. In one or more embodiments, more than one gaming facility may include gaming machines 115 with personalized T/C capability; in which case, a central server either at a selected gaming facility (e.g. T/C server 117) or external to gaming facilities (e.g. Ourjackpot.com website and server) may be utilized to update personalized T/C records and transmit the T/C data to gaming machines 115 on a real-time basis. In either case, the T/C data including leaderboards and/or winners may be posted on personalized T/C website 111 and transmitted to the participating players such as by email, voicemail, text, etc. if enabled by the website and respective players.

Figure 6:
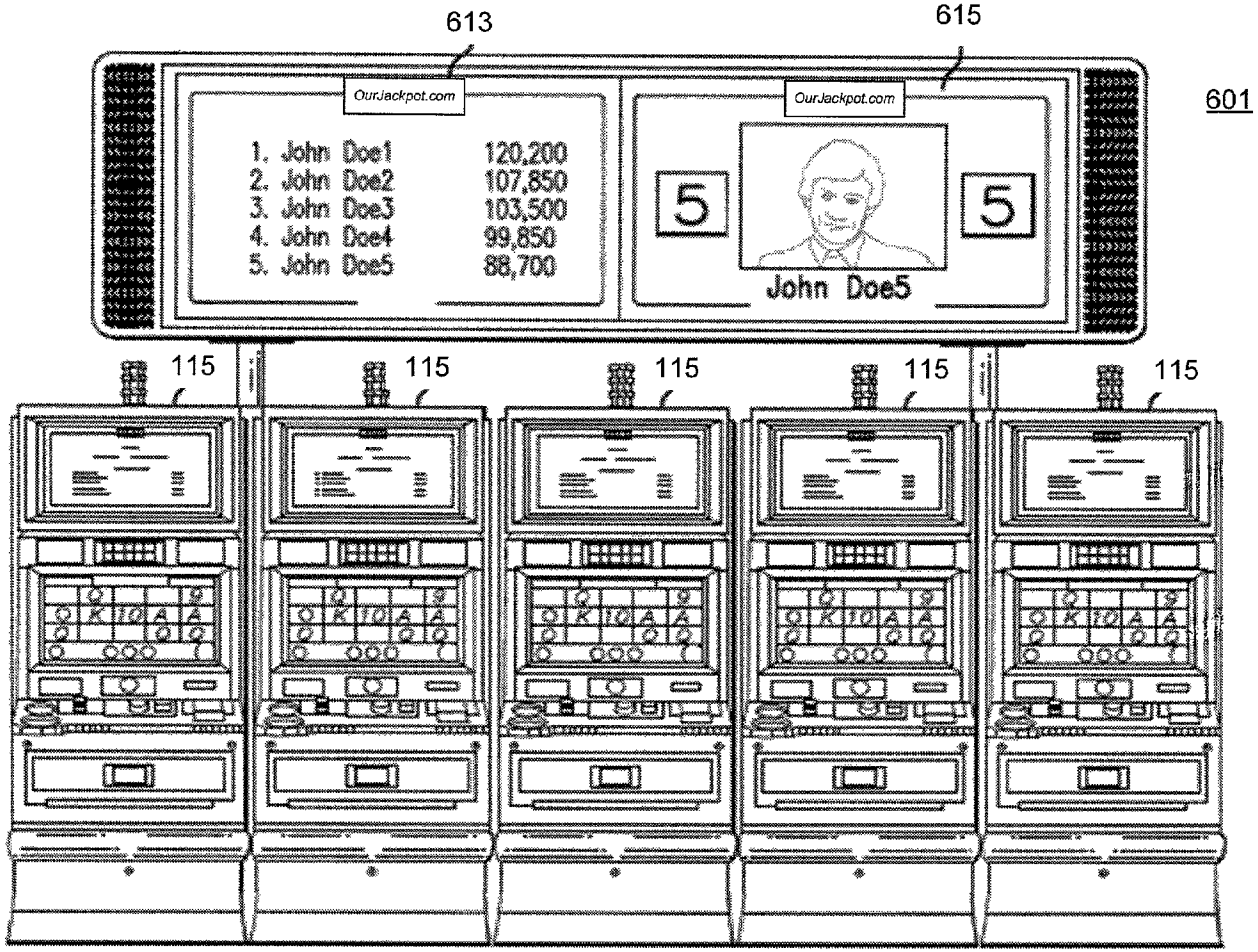
FIG. 6 illustrates an example networked bank of the gaming machines of FIGS. 2A and 2B wherein one or more players may participate in one or more personalized competitions and real-time leaderboards and player activity may be displayed periodically on the overhead display in accordance with one or more embodiments.

Referring to FIG. 6, example networked bank 601 is shown in accordance with one or more embodiments which includes a bank of gaming machines 115 wherein one or more players may participate in one or more personalized T/C which may be different from each of any other players playing on the bank. Players on bank 601 may or may not play in one or more personalized T/C; however, periodically real-time leaderboards on each of the personalized T/C being played by players on the bank may be displayed on overhead display 611. In the example shown, first portion 613 of overhead display 611 may display a leaderboard of one of the active personalized T/C being played by one of the players on the bank and second portion 615 may display one of the players playing in the personalized T/C shown in first portion 613, along with the player's position in the personalized T/C. Each of gaming machines 115 on bank 601 may have a color associated with the respective gaming machine which may be shown as a background on one of the displays and also shown along with the player and the player's position on overhead display 611 so that the player may be identified by others watching or participating.

Referring to FIGS. 7A-7K, an example set of web pages corresponding to personalized competition and tournament (T/C) website 111 (Ourjackpot.com) is shown as may be implemented in networked gaming system 100 (FIG. 1) in accordance with one or more embodiments. The example web pages include homepage 701, personalized jackpot page 703, personalized tournament page 705, personalized leaderboard page 707, personalized calendar page 709, personalized tournament setup page 711, game play page 713, sponsor links page 715, T/C member directory page 717, webhost informational page 719, and webhost contact page 721.

Upon accessing homepage 701, visitors or members accessing T/C website 111 may sign-in or register by inputting information or a request in corresponding interactive fields. If a visitor requests registration, then a setup page (not shown) may open and include various identifying data (such as name, address, credit card information, and age verification) and personal preferences (such as user ID, password, notification about T/C by email, voicemail, text, etc., times for notifications (e.g. daily, weekly, instantly), and linked player accounts).

Once logged into T/C website 111, personalized jackpot ("My jackpot Page") webpage 703 specific to the patron may open and provide a menu 723 including links to various other web pages of the site. Additionally, areas may be provided on webpage 703 to view updated information or access personal information 725, current tournament standings 727, tournaments for which the player is eligible 729, and accrued points and/or scores 731.

By accessing personalized tournament page 705 ("My Tournaments"), the patron may access information about the T/C for which the patron is eligible to play, the T/C rules, and the patron's entry status. Fields may also be provided to enter one or more T/C and to access a secure page to pay entry fees, if applicable. The patron may be enabled to pay through a credit card or a personalized T/C account that may automatically be setup when the patron initially registers with T/C website 111 and wherein the patron may add funds, receive awards, and/or withdraw funds. The T/C account may be administered directly through T/C website 111 and/or connect to a third party site (such as a bank) to enable seamless transactions and provide the benefit of federally insured accounts.

By accessing personalized leaderboard page 707, the patron may view details of each T/C leaderboard for which the patron is eligible to play, the patrons standing or score, whether the patron is currently enrolled, and whether various players on the leaderboard are currently in an active gaming session competing in one of the T/C. A selectable field may also enable the patron to set up a selected group of members to follow by viewing their scores, standing, and whether they are currently playing in one or more of the T/C. The T/C data as shown on page 707 and various other of the T/C webpages may be automatically populated and updated on a substantially real-time basis; along with these updates to the website, patrons may also elect to receive the updates (such as by email, voicemail, text, etc.) as generated or on the patron's time specified basis.

By accessing personalized calendar page 709 ("My Calendar"), the patron may view the dates and times of the T/C for which the patron is eligible. The calendar may also show T/C for which the patron is ineligible but which may be grayed out or otherwise indicate patron ineligibility. The patron may thereby be able to join a group or request to join a group from a group manager in order to gain eligibility for one or more T/C.

By accessing personalized tournament setup page 711, the patron may setup one or more T/C by selecting a MY TOURNAMENT icon and populating the data (such as from drop-down menus of selectable options which may include the eligible group of players, schedule of the event, location to play, eligible gaming devices, prizes, entry fee, sponsor, and how to signup). T/C website 111 may provide one or more basic T/C such that the patron may initiate a prepackaged tournament or competition on setup page 711 by indicating the eligible group and date; for example, in which case, all personalized T/C enabled gaming facilities and devices may be used to participate. Other standardized T/C may be provided on setup page 711 and may be further modified by the patron to further personalize one or more T/C.

By accessing game play page 713, the patron may play the available games online by selecting one of the icons. Depending upon jurisdictional restrictions, the patron may play the games for fun (as with promotional or non-value credits) or profit (as with actual currency in one form or another). In either case, the patron may accumulate T/C playing points that may be stored in association with the patron's T/C account. The patron's T/C player points may be used to populate associated leaderboards which may include total accumulated T/C player points for a single session or multiple sessions. The patron's T/C player points may also be accessed and used by participating facilities to provide promotional offers.

T/C website 111 may also include several informational pages such as: sponsors page 715 to indicate participating operators, facilities, and manufacturers; and member directory page 717 to enable interaction between patrons and to enable patrons to set up groups with specific patrons. When setting up groups, the group manager may send invitations that may be accepted prior to adding other patrons to the group or the website software may enable a group manager to add any other patron to the group managed by the respective group manager. Patrons may also be provided the option to drop themselves from a group and to block requests or invitations by other patrons such as by editing the patron's personalized data.

Figure 8:
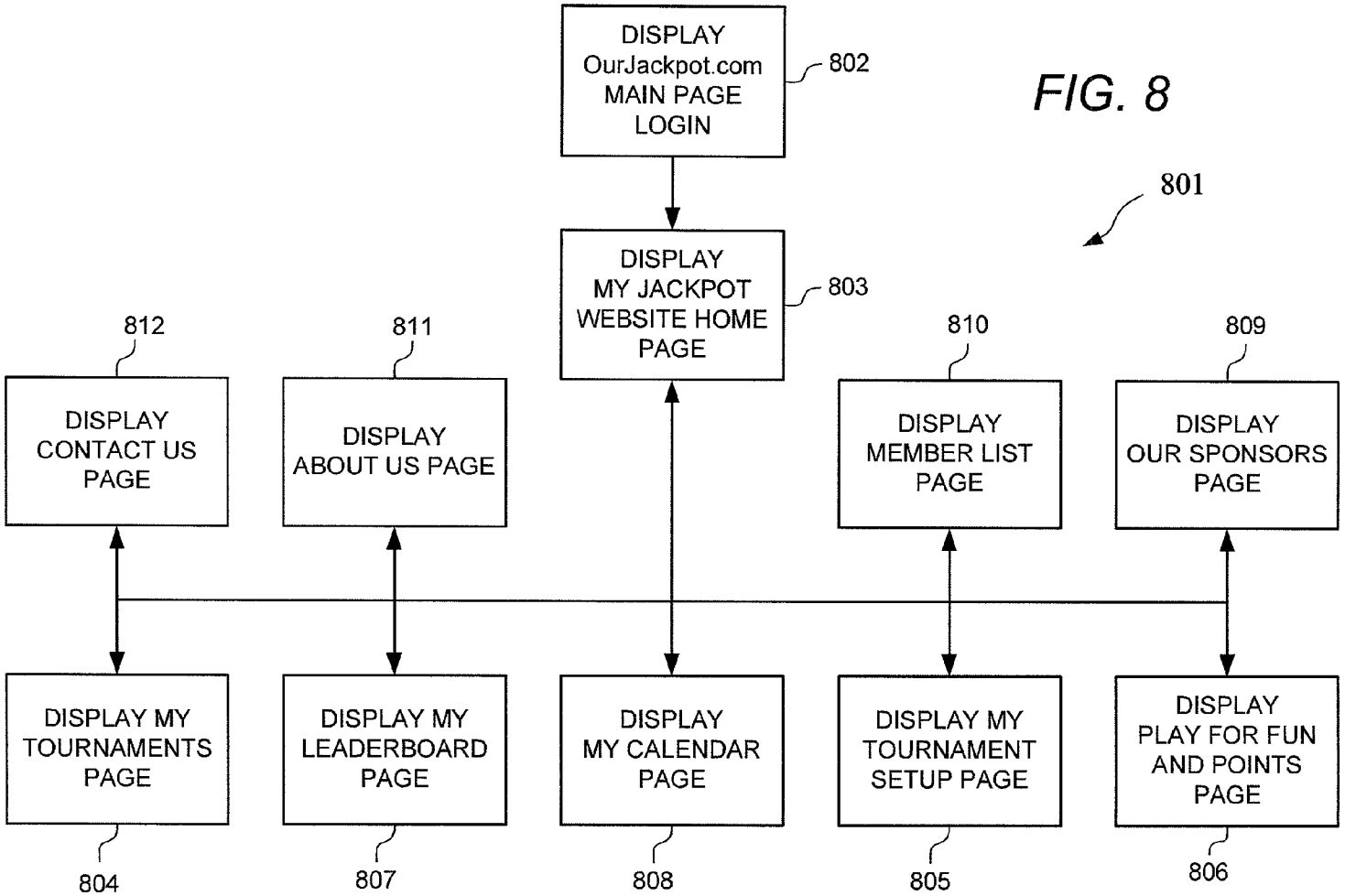
FIG. 8 illustrates an example flow diagram of the Ourjackpot.com website depicted in FIGS. 7A-7K.

Referring to FIG. 8, example flow diagram 801 is shown for T/C website 111 (e.g. Ourjackpot.com) as discussed above and particularly with reference to FIG. 7A-7K.

As shown in FIG. 8, the OurJackpot.com main webpage displays a logon page as indicated at process block 802. This OurJackpot.com main page provides a logon field or a create logon ID interactive icon so that the player may logon or create a logon account from a PC, PDA, phone, EGM or other suitable device. Once a player has logged on, the system displays the MY JACKPOT website homepage as indicated at process block 803. This webpage displays selectable tabs by which the player may select other webpages under the logon account (for example the My Tournaments, or Set up a Tournament page) and provides game information. For example, the game information may include current leaderboards and prizes and current tournaments or competitions. This MY JACKPOT homepage may also provide functionality to allow the logged on member to enable cell phone, e-mail, text, or voice mail messaging, etc., for receiving MyJackpot.com tournament notifications, leaderboard updates, player points/score updates, player invitations, etc. on a real-time basis. For updates, the player may select an option to receive updates in real time or on some other time basis such as hourly, daily, weekly, etc.

Process blocks 804 through 812 in FIG. 8 represent webpages that are displayed by selecting a tab from the MY JACKPOT website homepage. Also, each of these pages include a list of the other pages so that a player may navigate directly from one page to another without having to go back to the MY JACKPOT website homepage displayed as indicated at process block 803.

The My Tournaments webpage displayed as indicated at process block 804 provides the player with interactive elements to enter and review account information such as name, address, credit card number, player card numbers, current standing in enrolled tournaments and competitions, and current T/C invitations, for example. This webpage also provides fields for entry of credit and or player card information, provides interactive elements for example for uploading or redeeming credits to or from player accounts and or for paying a sign-up or entry fee in a tournament or competition.

The My Tournaments Setup webpage displayed as indicated at process block 805 in FIG. 8 provides interactive building block elements for creating a tournament or competition. For example, the player may select or create a player group from the player's own mailing list, a list of all or some existing MY JACKPOT members, or all players. The player may also select how points are awarded, select the prizes (fixed or progressive), how funded, and how won. The funding may be, for example, from entry fees, a sponsor, and/or a percentage of play (for example, wagers, outcomes, etc.). Tournament or competition wins may be set up to be based on most playing points such as a given sponsor's club points (MY JACKPOT playing points, specific in game outcomes, mystery random number generator, etc.). Through this setup page displayed as indicated at process block 805 the player may also select the eligible gaming machines for the tournament or competition, for example, one cent denomination gaming machines, a certain gaming machine brand or title, $0.25 poker, etc. or table games such as $5 blackjack or $25 craps, etc.

The Play for Fun and Points page displayed as indicated at process block 806 provides interactive games for players to play using some sort of currency such as, for example, play money, MY JACKPOT playing credits, transferable currency, government issued currency (as may be permitted to be used by law in various jurisdictions in association with game play). Games may be provided for use by affiliate gaming machine manufacturers, gaming operators, gaming software providers, etc., each of which may establish an account with the MY JACKPOT website with privileges to set up tournaments or competitions, sponsors, etc. Additionally, commercial members may purchase advertising to announce events or offer promotions to MY JACKPOT website members and/or visitors. The commercial members may be provided access to MY JACKPOT members playing records to provide offers or promotions, such as promotional credits, combinations, meals, etc.

The other webpages displayed as indicated at process blocks 806 through 812 in FIG. 8 provide functionality described above and/or apparent from the respective illustrated example webpage.

Referring to FIG. 9, example flow diagram 901 is shown of a personalized tournament/competition as may be played on gaming machines 115 through a network-connected gaming system such as that shown in FIG. 1. In this example, a player accesses a MY JACKPOT tournament/competition as indicated by process block 902 by initiating a gaming session on an eligible gaming machine (EGM) during a MY JACKPOT tournament/competition period for which the player is eligible. The player may initiate the gaming session conventionally such as by inserting a player card in a player tracking unit at the selected gaming machine, or insert cash, ticket, or the currency resulting in credits being applied to the gaming machine credit register and being displayed on the associated credit meter.

Once the gaming session is initiated, the network player tracking unit display of the gaming machine (or the interactive display 223 shown in FIG. 2A) may provide a menu as indicated at block 903 including account information and interactive elements usable to upload or download credits to or from a player account or to enter or continue to play in tournaments/competitions.

To play in a MY JACKPOT tournament, the player may select a MY JACKPOT icon or field identified on an interactive display (such as a player tracking unit display or display 223) and this selection is communicated to and received by the T/C server as indicated at block 904. If the player has not been identified such as by inserting a player card, the T/C server may cause an interactive display at the gaming machine to prompt the player for a player card or a MY JACKPOT ID and/or password. Once the player has been identified, the tournament or competitions for which the player is eligible may be provided by the T/C server and displayed to the player as indicated at process block 905. Through the interactive display, the player may be provided an option to enter (if not previously entered) or continue playing in one or more selected tournaments or competitions.

If the player has not enrolled to play in a tournament or competition game as indicated by a negative outcome at decision box 906, the process continues to process block 907 and the player may play games at the respective device in a conventional manner. For example, the player may make wagers, initiate gameplay, earn credits, earn casino player points (if available) based on gameplay, and cash out to conclude the gaming session.

If the player has enrolled to play a tournament or competition game, the process proceeds to process block 908 and the T/C server transmits T/C data to the gaming machine. The gaming machine then displays leaderboard, prizes, and player data and position, for example. The player then plays the games at the particular gaming machine in the conventional way for the tournament or competition as indicated at process block 910. During the course of play, the gaming machine transmits gameplay data in substantially real time to backend servers (for example post, player tracking, and T/C servers). The T/C server transmits participating real-time gameplay data to the MY JACKPOT website server, and, together with the MY JACKPOT website server, accumulates player tournament/competition points based on rules of particular tournament or competition, updates a leaderboard based on all participating players accumulated points, updates prizes, (if progressive), and transmits updated tournament/competition information to the gaming machine for display, and may further transmit one or more server determine prizes to the gaming machine based on gameplay or other criterion, for example, a random number generator or a point threshold achieved individually or amongst all players, etc. The MY JACKPOT server also updates display tournament/competition data associated with the website content including data transmitted to participating players e-mail and voicemail accounts. Furthermore, the player tracking server accumulates player points and transmits updated player point totals to the gaming machine.

If the tournament or competition has not ended after a given gameplay at the gaming machine, the process returns for the next game play unless the player elects to end the gaming session (for example, to cash out or zero credits). However, if the tournament or competition has ended as indicated by an affirmative outcome at decision box 916, the process proceeds to process block 917. According to this process, the T/C server transmits instructions to pay awards and, transmits final leader boards, prizes, and respective player position for display at the participating gaming machines. The instructions to way awards for the tournament or competition play may be communicated, for example, to the gaming machine where the awards are made through the gaming machine, or to a player account server where the awards are made through such a server. Thereafter, the player may log out or continue to play until the player elects to end the gaming session as indicated at block 918 in FIG. 9.

Referring generally to the forgoing description, as used herein the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described example embodiments are intended to illustrate the principles of the invention, but not to limit the scope of the invention. Various other embodiments and modifications to these preferred embodiments may be made by those skilled in the art without departing from the scope of the present invention.

For example, in one or more alternative embodiments, the gaming systems and methods as discussed herein may be implemented on a small or modular scale. For example, one or more banks of gaming machines 115 may be T/C enabled through a T/C control unit (such as one of the gaming machines, a floor server, or back-end server). As another example, patrons may register and set up a T/C account to compete in one or more T/C by accessing a kiosk connected to the T/C control unit. The kiosk may be programmed in a manner similar to T/C website 111 and enable patrons to browse through personalized T/C pages and setup one or more T/C. For example, a group of players may arrive at a facility and elect to set up a tournament or competition amongst themselves for a specified duration; each of the players may register and sign up to the XYZ group; the players may agree to set up a pot such as by each player putting in $20; the players may set up a number of places such as 1st, 2nd, 3rd and corresponding awards. The facility may charge a percent (e.g. 2%) of the pot for administration. The process of group enrollment may be simplified for those patrons registering to stay at a T/C enabled facility whereby upon registering for the stay, the patrons may include the group with which they are associated and the facility operator may automatically populate a T/C account for the patrons including their association with the group (e.g. Multimedia Games). In one or more further embodiments, the content of T/C website 111 may be incorporated in an operator's website (e.g. www.wynnresorts.com) wherein patrons may set up one or more groups and T/C to play at the operator's facilities during a selected time period.

In one or more further alternative embodiments, the group manager may receive a portion of the handle from game play (e.g. 0.5% of wagers) which for example may be paid to the group manager's Ourjackpot account from the casino facility/facilities where the tournament/competition is played. In one or more examples, the games played and/or gaming devices may be self-standing RNG-, server RNG-, bingo-, lottery, or sweepstakes-based without taking away from the aspects of play or operation as discussed herein; for example, FIG. 1 shows central determinant server 124 (e.g. to enable bingo, lottery, or sweepstakes game outcome determinantions transmitted to networked gaming machines 115 with bingo, lottery, or sweepstakes-based games) and game server 123 (e.g. to enable server-based game outcomes to be generated and transmitted to server-based networked gaming devices such as may be implemented with gaming machines 115). In one or more embodiments, the primary game may be implemented with electromechanical reels as opposed to video reels; also, the primary game may be any of various types of wagering games such as for example table-style games (e.g. video poker, video black jack, video roulette reel, video craps, etc.).

In one or more further alternative embodiments, a player may obtain and post multiple scores in a single T/C game. For example, a group competition score may be obtained in association with each wager in a primary game and each score may be ranked in relation to any other scores of eligible group participants (e.g. three Multimedia Games® cherries on a line may pay a "10" credit award in the base game which T/C server 117 may convert to a "1000" point score based on the game rules (for example, if a first player is competing in only one competition and the wager contribution is 1.5% to a jackpot pool; whereas if a second player competes in three competitions simultaneously and contributes 0.5% of wagers to the jackpot pool of each competition then the second player's point score may be ⅓ less than the first player's based on a same credit award) and then use that value to determine a ranking versus any other scores in the group competition; at the end of the competition, the player or players with the three highest scores may receive corresponding awards).

What is claimed is:

1. A personalized group competitive game including:

a player interface enabling a first player to specify one or more criteria for the game and select one or more additional players to compete in the game;

an award for which the first player and the one or more additional players compete by playing one or more underlying games; and an accumulation of awards from outcomes of the underlying games by each of the players determining payment of the award to a winning one of the players.

2. The personalized group competitive game of claim 1, wherein the underlying games are wagering games.

3. The personalized group competitive game of claim 1, wherein the outcomes are randomly or pseudo-randomly determined outcomes.

4. The personalized group competitive game of claim 1, wherein the player interface also enables the first player to specify a set of players to play the game.

5. The personalized group competitive game of claim 1, wherein the player interface enables the first player to define one or more types of wagering games as the underlying games.

6. The personalized group competitive game of claim 1, wherein the player interface enables the first player to define a time period for the underlying games as a criteria for the game.

7. A personalized group competitive game including:

a player interface enabling a first player to enter player identification information, specify one or more criteria for the game, and select one or more additional players to compete in the game;

an award for which the first player and the one or more additional players compete by playing one or more underlying games; and an accumulation of awards from outcomes of the underlying games by each of the players determining payment of the award to a winning one of the players.

8. The personalized group competitive game as in claim 7 wherein the accumulation of awards occurs during a predetermined period of time specified as one of the one or more criteria for the game.

9. The personalized group competitive game as in claim 7 wherein the one or more underlying games are preselected as one of the one or more criteria for the game.

10. The personalized group competitive game as in claim 7 including:

the player interface enabling the transmission of a request to the one or more additional players to compete in the game.

11. The personalized group competitive game as in claim 7 wherein the one or more additional players are part of a group selected by the first player.

12. The personalized group competitive game as in claim 11 wherein the group comprises a set of players from one or more of a selected player level of a casino facility players club, a selected association, a selected club and a selected company.

* * * * *